US007648038B2

(12) United States Patent
Brozell

(10) Patent No.: US 7,648,038 B2
(45) Date of Patent: Jan. 19, 2010

(54) CONTAINER AND PLASTIC HANDLE SYSTEM

(75) Inventor: Leonora M. Brozell, Maumee, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 519 days.

(21) Appl. No.: 11/418,435

(22) Filed: May 4, 2006

(65) Prior Publication Data

US 2007/0257005 A1 Nov. 8, 2007

(51) Int. Cl.
*B65D 23/10* (2006.01)

(52) U.S. Cl. ..... 215/396; 220/758; 220/769; 220/762

(58) Field of Classification Search ..... 215/396; 220/758, 765, 752, 769, 762
See application file for complete search history.

(56) References Cited

U.S. PATENT DOCUMENTS 2,598,747 A * 6/1952 Alex ..... 294/27.1
2,610,081 A * 9/1952 Bushman ..... 294/28
2,760,808 A * 8/1956 Moyer et al. ..... 294/31.2
2,869,747 A 1/1959 Patterson
3,021,026 A * 2/1962 Clare ..... 215/395
3,275,366 A * 9/1966 Hidding ..... 294/31.2
3,400,865 A * 9/1968 Hester ..... 222/475
3,516,580 A * 6/1970 Hester ..... 222/475.1
3,990,596 A * 11/1976 Hoftman ..... 215/11.1
4,368,826 A * 1/1983 Thompson ..... 215/398
4,379,578 A * 4/1983 Schuler ..... 294/31.2
4,456,135 A * 6/1984 Beekes ..... 215/396
4,486,043 A * 12/1984 Rais ..... 294/27.1
4,747,498 A 5/1988 Gach
4,821,372 A * 4/1989 Casiello ..... 16/425
4,832,216 A * 5/1989 Reyes ..... 215/398

(Continued)

FOREIGN PATENT DOCUMENTS

WO WO 2005/085078 9/2005

OTHER PUBLICATIONS

PCT Int'l Application No. PCT/US2007/009886 International Preliminary Report on Patentability—Chaper I Written Opinion Dated: Nov. 4, 2008.

*Primary Examiner*—Anthony Stashick
*Assistant Examiner*—Christopher B McKinley
(74) *Attorney, Agent, or Firm*—Reising Ethington PC

(57) ABSTRACT

A package includes a container having a neck finish with at least one left-hand external thread segment, a fitment having at least one left-hand internal thread segment for threaded receipt over the container neck finish and at least one right-hand external thread segment, a closure having at least one right-hand internal thread segment for removable receipt over the fitment, and a handle attached to the container by the fitment. The container neck finish preferably has a transfer ring, and the handle preferably has a collar received over the transfer ring and held in place by the fitment. The transfer ring and the collar preferably have opposed flats to prevent rotation of the handle with respect to the transfer ring. The collar and the fitment preferably have opposed cam lugs that permit threading of the fitment onto the container neck finish over the collar but prevent unthreading of the fitment from the neck finish so that the fitment and handle are permanently attached to the container neck finish.

19 Claims, 2 Drawing Sheets

U.S. PATENT DOCUMENTS 4,896,913 A * 1/1990 Kennedy ..... 294/31.2
4,909,403 A * 3/1990 Reyes ..... 215/398
4,936,614 A * 6/1990 Russell ..... 294/27.1
4,955,572 A 9/1990 Simmons
5,104,010 A * 4/1992 Codorniz et al. ..... 222/475
5,224,634 A * 7/1993 Graham ..... 222/475.1
5,297,686 A * 3/1994 Takeuchi ..... 215/396
D350,879 S * 9/1994 Gelston ..... D7/622
5,487,482 A * 1/1996 Rocheleau ..... 215/396
5,692,630 A * 12/1997 Hsu ..... 215/396
D396,385 S * 7/1998 Lisciotti et al. ..... D7/622
5,799,811 A * 9/1998 Bruckner et al. ..... 215/386
5,897,150 A * 4/1999 Rubini ..... 294/27.1
5,975,369 A 11/1999 Yurkewicz et al.
5,988,419 A * 11/1999 St John ..... 215/398
6,352,235 B2 * 3/2002 Cizek ..... 248/692
6,364,385 B1 * 4/2002 Steward et al. ..... 294/27.1
6,415,937 B1 * 7/2002 DeJong et al. ..... 215/386
6,527,109 B2 3/2003 Schoo et al.
6,561,390 B2 * 5/2003 Boyte et al. ..... 222/475.1
D493,675 S 8/2004 Panico
D496,584 S 9/2004 Darr et al.
6,851,565 B2 2/2005 Stephan
6,872,116 B1 * 3/2005 Dunnum et al. ..... 446/73
6,926,163 B2 * 8/2005 Darr et al. ..... 215/396
6,959,827 B2 * 11/2005 Morano et al. ..... 215/396
6,978,908 B2 * 12/2005 Morano et al. ..... 215/396
7,143,904 B2 * 12/2006 Zhang et al. ..... 215/396
2001/0027956 A1 * 10/2001 Bonacorso et al. ..... 215/11.1
2002/0179605 A1 * 12/2002 Miani et al. ..... 220/277
2005/0056611 A1 * 3/2005 Hakim ..... 215/11.6
2006/0124579 A1 * 6/2006 Nielson ..... 215/396
2006/0124580 A1 * 6/2006 Zhang et al. ..... 215/396
2006/0273059 A1 * 12/2006 Mendenhall et al. ..... 215/11.1
2007/0090113 A1 * 4/2007 Otsuka ..... 220/304
2007/0221607 A1 * 9/2007 Piccioli et al. ..... 215/396
2007/0221608 A1 * 9/2007 Axe et al. ..... 215/396

* cited by examiner

CONTAINER AND PLASTIC HANDLE SYSTEM

The present disclosure relates to a handle system for attachment to the neck finish of a preformed container, and more particularly to a plastic handle system for attachment to the neck finish of a glass container.

BACKGROUND AND SUMMARY OF THE DISCLOSURE

Molding a handle integrally with a container, particularly a glass container, can be expensive both in terms of mold tooling complexity and in terms of the cost of the material forming the handle. It is a general object of the present disclosure to provide a handle system, preferably a plastic handle system, for attachment to a preformed container, preferably a glass container.

The present disclosure embodies a number of aspects that can be implemented separately from or in combination with each other.

A package in accordance with one aspect of the present disclosure includes a container having a neck finish with at least one left-hand external thread segment, a fitment having at least one left-hand internal thread segment for threaded receipt over the container neck finish and at least one right-hand external thread segment, a closure having at least one right-hand internal thread segment for removable receipt over the fitment, and a handle attached to the container by the fitment. The container neck finish preferably has a transfer ring, and the handle preferably has a collar received over the transfer ring and held in place by the fitment. The transfer ring and the collar preferably have opposed flats to prevent rotation of the handle with respect to the transfer ring. The collar and the fitment preferably have opposed cam lugs that permit threading of the fitment onto the container neck finish over the collar but prevent unthreading of the fitment from the neck finish so that the fitment and handle are permanently attached to the container neck finish.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 2:
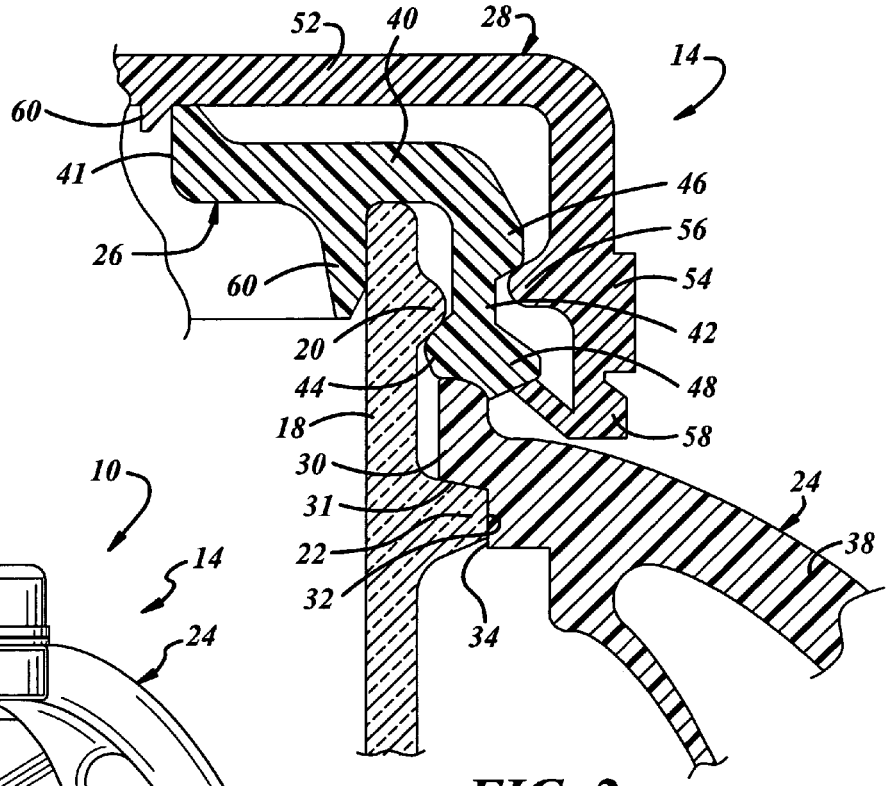
FIG. 2 is a fragmentary sectional view of the handle system attached to the container neck finish in the package of FIG. 1.

The drawings illustrate a package 10 in accordance with an exemplary embodiment of the disclosure as including a container 12 to which a handle system 14 is attached. Container 12 preferably is of molded glass construction and includes a body 16 from which a neck finish 18 integrally extends. Neck finish 18 has an open end that surrounds the container mouth, at least one reverse direction or left-hand external thread segment 20 adjacent to the container mouth, and an external transfer ring 22 spaced from the container mouth. Transfer ring 22 extends at least part way around neck finish 18 and preferably is circumferentially continuous. The term "thread segment" is employed in its usual broad sense to include both single and multiple threads, and both continuous and discontinuous threads. Neck finish 18 preferably is cylindrical.

Handle system 14 in the exemplary embodiment of the disclosure includes a handle 24, a fitment 26 and a closure 28. Handle 24, fitment 26 and closure 28 preferably are each of molded plastic construction, such as injection molded plastic construction. Handle 24 includes a circumferentially continuous annular collar 30 that is telescopically received in assembly over transfer ring 22 on container neck finish 18 so that an internal shoulder 31 of collar 30 rests on the upper surface of the transfer ring. Transfer ring 22 preferably has an external flat 32 that is engaged by an opposed internal flat 34 within collar 30 to prevent rotation of handle 24 with respect to container neck finish 18. A circumferential array of cam lugs 36 are provided around the top surface of collar 30. Each cam lug 36 has a sloping clockwise facing surface, as viewed from above, and a sharp counterclockwise facing edge. A handle portion 38 extends from collar 30 and may be of any suitable geometry.

Fitment 26 includes a deck 40, which may be flat, conical or of any other suitable geometry. A dispensing opening 41 is formed in deck 40 of fitment 26. The dispensing opening can be of any suitable geometry. A peripheral skirt 42 extends from deck 40. Skirt 42 has at least one reverse or left-hand internal thread segment 44 for threaded engagement with external thread segment(s) 20 on neck finish 18. Skirt 42 also has at least one right-hand external thread segment 46. Skirt 42 preferably also has an external bead 48 at a position spaced from deck 40, and cam lugs 50 on the end of skirt 42 spaced from deck 40. Cam lugs 50 have sharp clockwise-facing edges (as viewed from above) and sloping counterclockwise-facing surfaces that ride over cam lugs 36 on handle 24 as fitment 26 is threaded in a left-hand or reverse direction onto container neck finish 18. With fitment 26 tightly threaded onto container neck finish 18, lugs 36, 50 cooperate with flats 32, 34 between transfer ring 28 and handle 24 to prevent right-hand rotation of handle 24 and fitment 26 on the container neck finish, and thereby to prevent removal of the fitment and the handle. An annular wall 52 preferably extends from deck 40 in plug-sealing engagement within the mouth of the container neck finish.

Figure 1:
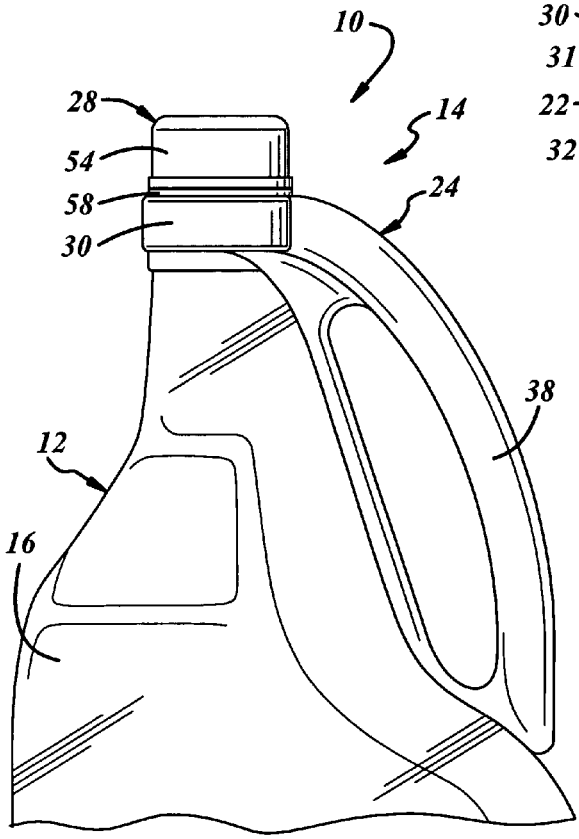
FIG. 1 is a fragmentary elevational view of a package that includes a container and a handle system in accordance with an exemplary embodiment of the present disclosure.
Figure 3:
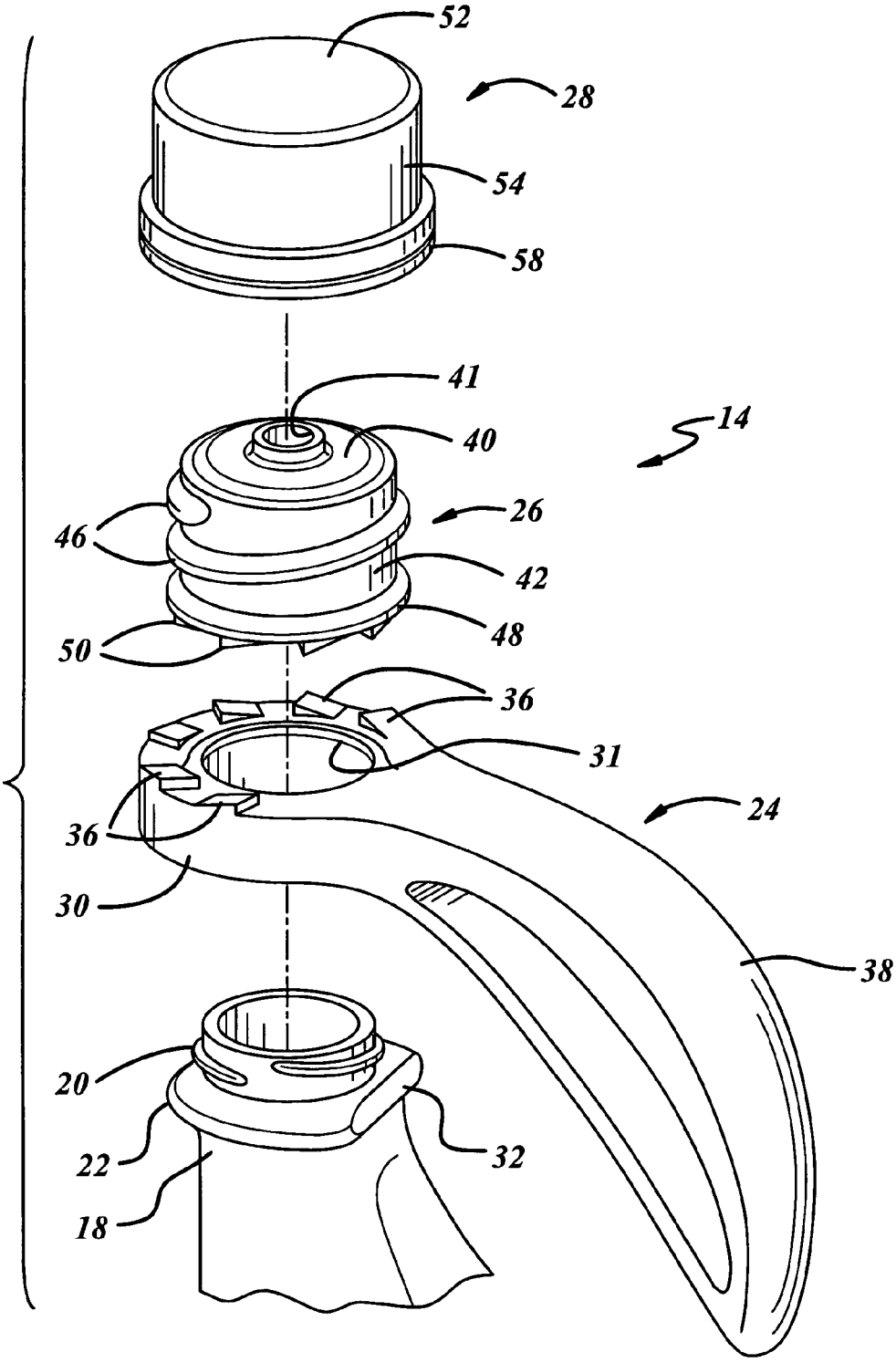
FIG. 3 is an exploded perspective view of the handle system and container neck finish in the package of FIGS. 1 and 2.

Closure 28 can be of any suitable geometry. In the exemplary embodiment of the disclosure, closure 28 includes a base wall 52 and a peripheral skirt 54. Peripheral skirt 54 has one or more internal thread segments 56 for engagement with external thread segment(s) 46 on fitment 26 to secure closure 28 to fitment 26. Closure 28 preferably also has an annular tamper band 58 frangibly connected to the free end of skirt 54 for engagement with beneath bead 48 on fitment 26 when closure 28 is fully assembled to fitment 26 as illustrated in FIGS. 1 and 2. Such engagement between tamper band 58 and bead 48 provides tamper indication by frangibly separating band 58 from skirt 54 when closure 28 is first unthreaded from fitment 26. In the exemplary embodiment, an annular wall 60 extends from the base wall 52 for plug-sealing engagement with dispensing opening 41 of fitment 26.

Handle 24, fitment 26 and closure 28 may be of any suitable molded plastics such as polypropylene. The container and handle may be provided as a subassembly to a packager, such as by providing an interference fit between collar 30 and ring 32, as can the fitment and closure. The packager would then fill the container with product and secure the closure/fitment subassembly to the container neck finish. As an alternative, the handle could be provided separately from the container, so that the packager would fill the container either before or after applying the handle, and then secure the closure/fitment sub-assembly to the container. Of course, the handle, the fitment and the closure could be provided as separate non-assembled elements to the packager, who could fill the container with product, and apply the handle, the fitment and the closure to the filled package.

The present disclosure has been presented in conjunction with an exemplary presently preferred embodiment, and a number of modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A package that includes:

a container having a neck finish with at least one left-hand external thread segment, a fitment having at least one left-hand internal thread segment for threaded receipt over said neck finish and at least one right-hand external thread segment, a closure having at least one right-hand internal thread segment for removable receipt over said externally threaded portion of said fitment, and a handle non-rotatably received over said neck finish and non-removably captured to said container by said fitment so that the fitment and handle are permanently attached to the container neck finish.

2. The package set forth in claim 1 wherein said container neck finish has a transferring, and wherein said handle has a collar received over said transfer ring and held in place by said fitment.

3. The package set forth in claim 2 wherein said transfer ring has an external flat and said collar has an internal flat in engagement with said external flat to prevent rotation of said handle with respect to said transfer ring and said neck finish.

4. The package set forth in claim 2 wherein said collar and said fitment have opposed lugs that prevent right-hand rotation of said fitment and said handle with respect to each other.

5. The package set forth in claim 4 wherein said opposed lugs comprise cam lugs constructed and arranged to permit left-hand threading of said fitment onto said neck finish over said collar and to prevent right-hand unthreading of said fitment from said neck finish.

6. The package set forth in claim 1 wherein said fitment has a wall in plug-sealing engagement within said container neck finish.

7. The package set forth in claim 1 including tamper-indicating means between said closure and said fitment.

8. The package set forth in claim 7 wherein said fitment includes a deck having a dispensing opening, a peripheral skirt that includes said internal and external thread segments, and an annular wall extending from said deck within said skirt for plug-sealing engagement within said neck finish.

9. The package set forth in claim 1 wherein said container is of glass construction, and said fitment, said handle and said closure are of plastic constructions.

10. A package that includes:

a glass container having a neck finish with a mouth, at least one left-hand external thread segment adjacent to said mouth and a transfer ring extending around said neck finish at a position spaced from said mouth, a plastic handle having a collar non-rotatably received over said transfer ring, said transfer ring and said collar having opposed flats that prevent rotation of said collar and said handle with respect to said container neck finish, a plastic fitment having a deck with a peripheral skirt and an annular wall within said skirt in plug-sealing engagement within said container mouth, said peripheral skirt having at least one left-hand internal thread segment threadably received over said container neck finish non-removably capturing said handle on said transfer ring so that the fitment and handle are permanently attached to the container neck finish, and at least one right-hand external thread segment, and a plastic closure having at least one right-hand internal thread segment removably received over said at least one external thread segment of said fitment.

11. The package set forth in claim 10 wherein said collar and said fitment have opposed lugs that prevent right-hand rotation of said fitment and said handle with respect to each other.

12. The package set forth in claim 11 wherein said opposed lugs comprise cam lugs constructed and arranged to permit left-hand threading of said fitment onto said neck finish over said collar and to prevent right-hand unthreading of said fitment from said neck finish.

13. The package set forth in claim 12 including tamper-indicating means between said closure and said fitment.

14. A plastic handle system for mounting a container having a neck finish with a mouth, at least one left-hand external thread segment adjacent to said mouth and a transfer ring extending around said neck finish at a position spaced from said mouth, said plastic handle system including:

a plastic handle having a collar adapted to be non-rotatably received over said transfer ring, a plastic fitment having at least one left-hand internal thread segment for threaded receipt over the container neck finish non-removably capturing said handle on said transfer ring so that the fitment and handle are permanently attachable to the container neck finish, and at least one right-hand external thread segment, and a plastic closure having at least one right-hand internal thread segment for removable receipt over said at least one external thread segment of said fitment.

15. The plastic handle system set forth in claim 14 wherein said collar has an internal flat for engagement with an external flat on the transfer ring to prevent rotation of said handle with respect to the transfer ring and the neck finish.

16. The system set forth in claim 15 wherein said collar and said fitment have opposed lugs that prevent right-hand rotation of said fitment and said handle with respect to each other.

17. The system set forth in claim 16 wherein said opposed lugs comprise cam lugs constructed and arranged to permit left-hand threading of said fitment onto the neck finish over said collar and to prevent right-hand unthreading of said fitment from the neck finish.

18. The system set forth in claim 14 including tamper-indicating means between said closure and said fitment.

19. The system set forth in claim 14 wherein said fitment has a wall inplug-sealing engagement within the container neck finish.

* * * * *

UNITED STATES PATENT AND TRADEMARK OFFICE

CERTIFICATE OF CORRECTION

PATENT NO. : 7,648,038 B2
APPLICATION NO. : 11/418435
DATED : January 19, 2010
INVENTOR(S) : Leonora M. Brozell It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 631 days.

Signed and Sealed this

Sixteenth Day of November, 2010

David J. Kappos

David J. Kappos
*Director of the United States Patent and Trademark Office*